US005209698A

United States Patent [19]

Dolan

[11] Patent Number: 5,209,698

[45] Date of Patent: May 11, 1993

[54] PIGGYBACK LABEL WITH CF OR SELF-CONTAINED COATING

[75] Inventor: David J. Dolan, Goffstown, N.H.

[73] Assignee: Moore Business Forms, Inc., Grand Island, N.Y.

[21] Appl. No.: 828,175

[22] Filed: Jan. 30, 1992

[51] Int. Cl.[5] ..... B41L 1/20

[52] U.S. Cl. ..... 462/17; 283/81; 283/72; 283/101; 281/2

[58] Field of Search ..... 462/17, 22, 25; 283/81, 283/72, 73, 94, 101; 281/2, 5

[56] References Cited

U.S. PATENT DOCUMENTS

| | | | |
|---|---|---|---|
| 4,189,353 | 2/1980 | Harriman | 283/6 |
| 4,379,573 | 4/1983 | Lomeli et al. | 428/42 |
| 4,637,635 | 1/1987 | Levine | 283/101 |
| 4,664,416 | 5/1987 | Steidinger | 282/11.5 A |
| 4,674,771 | 6/1987 | Thompson, II | 282/8 R |
| 4,700,976 | 10/1987 | Loose | 283/101 |
| 4,705,298 | 1/1987 | Van Malderghem et al. | 282/11.5 A |
| 4,824,142 | 4/1989 | Dossche | 282/11.5 A |
| 4,910,058 | 3/1990 | Jameson | 428/42 |
| 4,938,505 | 7/1990 | Gruttemeyer et al. | 282/11.5 R |
| 4,938,507 | 7/1990 | Ashby et al. | 282/9 R |
| 4,948,450 | 8/1990 | Hurter et al. | 156/310 |
| 4,951,969 | 8/1990 | Epstein et al. | 283/67 |
| 4,982,894 | 1/1991 | Schmidt | 229/69 |
| 5,024,374 | 6/1991 | Ashby et al. | 229/71 |
| 5,029,901 | 7/1991 | Dotson et al. | 462/17 |

*Primary Examiner*—Mark Rosenbaum
*Assistant Examiner*—Willmon Fridie
*Attorney, Agent, or Firm*—Nixon and Vanderhye

[57] ABSTRACT

A business form that may be easily and inexpensively produced provides a security feature while allowing ready printing of variable information on carbonless sheets, and ready utilization of variable security information. Top and bottom sheets of base paper have their bottom and top surfaces, respectively, in engagement with each other. A label is applied to the top surface of the bottom sheet, underlying a blockout printing strip on the top surface of the top sheet. Carbonless imaging means, such as a self-imaging coating on the label and top surface of the bottom sheet (or a CB coating on the bottom surface of the top sheet and a CF coating on the top surface of the bottom sheet, at least at the label), transfer variable data printed on the blockout printing to the label, and preferably to part of the bottom sheet adjacent the label. An adhesive strip, with release tape over it, may be provided on the bottom surface of the bottom sheet. The top and bottom sheets may be connected together by spot pasting along the top and bottom edges, and solid pasting in removable marginal portions at the side edges. The form is preferably part of a continuous business form construction.

20 Claims, 2 Drawing Sheets

FIG. 1
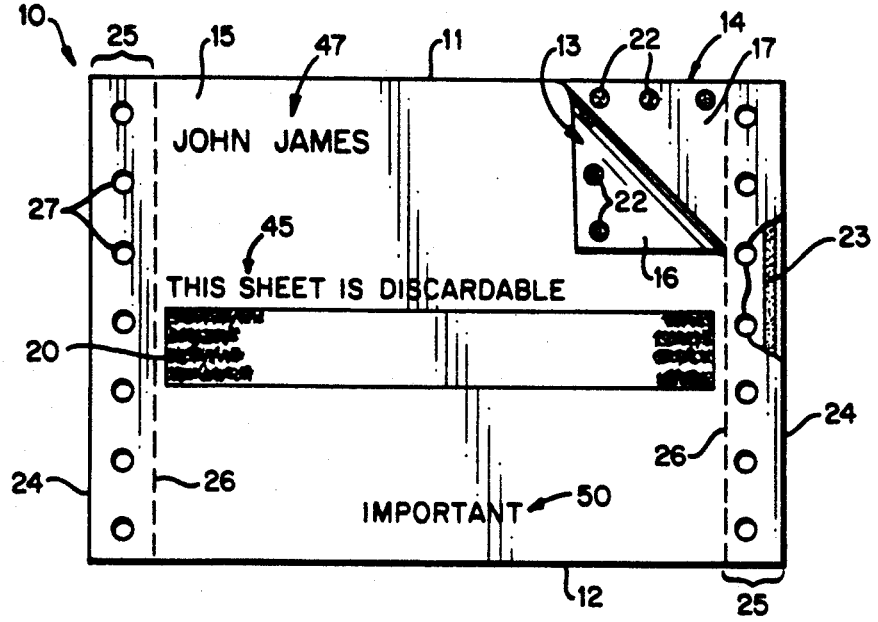
FIG. 2
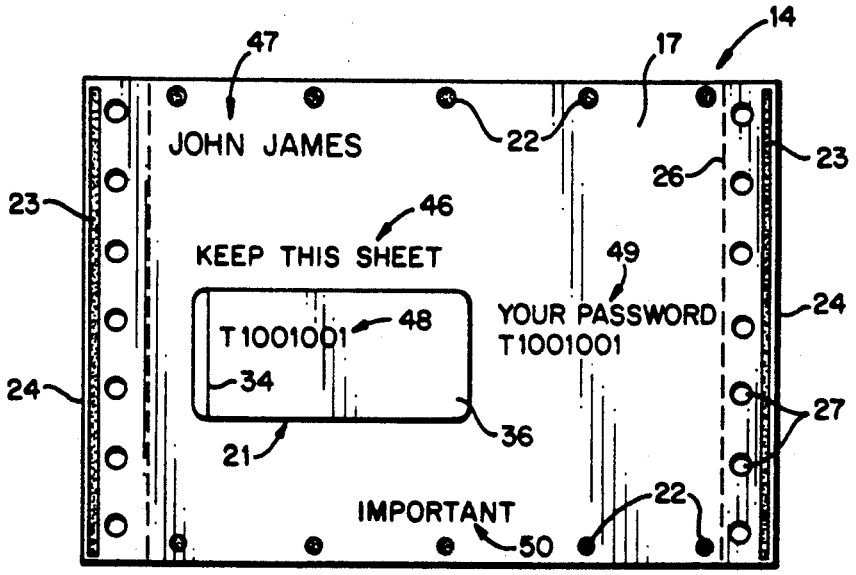
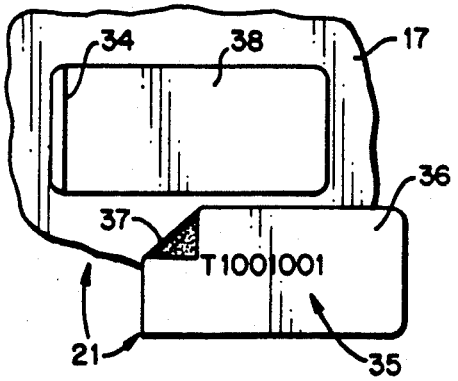
FIG. 3

PIGGYBACK LABEL WITH CF OR SELF-CONTAINED COATING

BACKGROUND AND SUMMARY OF THE INVENTION

There are many situations in which it is desirable to print confidential information on one part of a business form yet not have that confidential information visible on the top part of the business form, and to provide the confidential information in such a manner that it may be effectively utilized, e.g., printed on a removable label. These requirements are often very difficult to meet inexpensively and in an easily producible manner. For example, by some conventional manufacturing processes require processing through a conventional press for opas ink, application at relatively slow speeds (200–250 ft. per minute) of label stock. Once the label stock is coated with a CF coating it is then taken to a Webtron press for flexoink coverage on the same sheet and for matrix removal. Carbonless sheets are printed on a conventional press and then the label stock is affixed to the bottom sheet of the form by a blow-on application, and then the two sheets are bound together to form the finished product.

According to the invention, it is possible to simplify the manufacturing process, and to make the product much more inexpensive. According to the present invention, it is possible to use conventional base papers for the main parts of the form, to run all parts on Webtron equipment with only pass to achieve desired results, and to produce a product which has excellent security features.

According to one aspect of the present invention, a business form is provided comprising the following elements: Top and bottom sheets of printable material, each having a top surface and a bottom surface, and releasably retained together with the top sheet substantially coextensive with and covering the bottom sheet, with the top sheet bottom face abutting the bottom sheet top face. A label affixed to the top surface of the bottom sheet, the label having dimensions significantly less than the dimensions of the top and bottom sheets. Blockout printing provided on the top sheet top surface, the blockout printing substantially overlapping the label. Carbonless imaging means for imaging characters formed on the blockout printing onto the label. Transfer tape may be provided on the bottom surface of the bottom sheet in order to allow the bottom sheet to be affixed to a surface, and a slit may be provided in the label allowing ready removal of it from the bottom sheet. Top and bottom sheets may be connected together by spot pasting along the top and bottom edges, and solid pasting along removable marginal side edge portions.

While the carbonless imaging means may comprise a CB coating on the top sheet bottom surface (at least in alignment with the block printing, and preferably over the entire sheet) and a CF coating (on at least the label, and preferably the entire top surface of the bottom sheet), maximum simplicity in manufacture is obtained especially where a self-imaging coating is applied to the top surface of the bottom sheet (including the label).

According to another aspect of the present invention, a continuous-form business form comprises a plurality of edge connected continuous individual business forms are provided. Each individual business form comprises top and bottom sheets of printable material, each having a top surface and a bottom surface, and releasably retained together with the top sheet substantially coextensive with and covering the bottom sheet, and with the top sheet bottom face abutting the bottom sheet top face. A label is affixed to the-top surface of the bottom sheet, the label having dimensions significantly less than the dimensions of the top and bottom sheets. Carbonless imaging means are provided for imaging onto the label characters formed on the top sheet top surface. A strip of adhesive is formed on the bottom sheet bottom surface, and a release liner covers the adhesive strip.

According to another aspect of the present invention, a business form is provided comprising: Top and bottom sheets of base paper, each having a top surface and a bottom surface, and releasably retained together with the top sheet substantially coextensive with and covering the bottom sheet, with the top sheet bottom face abutting the bottom sheet top face. A label is affixed to the top surface of the bottom sheet, the label having dimensions significantly less than the dimensions of the top and bottom sheets. Blockout printing is provided on the top sheet top surface, the blockout printing substantially overlapping the label. Carbonless imaging means are provided for imaging onto the label characters formed on the blockout printing, and the carbonless imaging means comprises self-imaging material disposed on at least the label.

It is a primary object of the present invention to provide a simple and inexpensive piggyback label construction business form, including desirably having a security feature. This and other objects of the invention will become clear from an inspection of the detailed description of the invention in view of the appended claims.

BRIEF DESCRIPTION OF THE DRAWINGS

FIG. 1 is a top plan view of an exemplary business form according to the present invention with the top right corner of the top sheet peeled away for clarity of illustration;

FIG. 2 is a top plan view of just the bottom sheet of the business form of FIG. 1;

FIG. 3 is a top perspective exploded view showing the detachment of the label from the business form bottom sheet of FIG. 2;

DETAILED DESCRIPTION OF THE DRAWINGS

Figure 4:
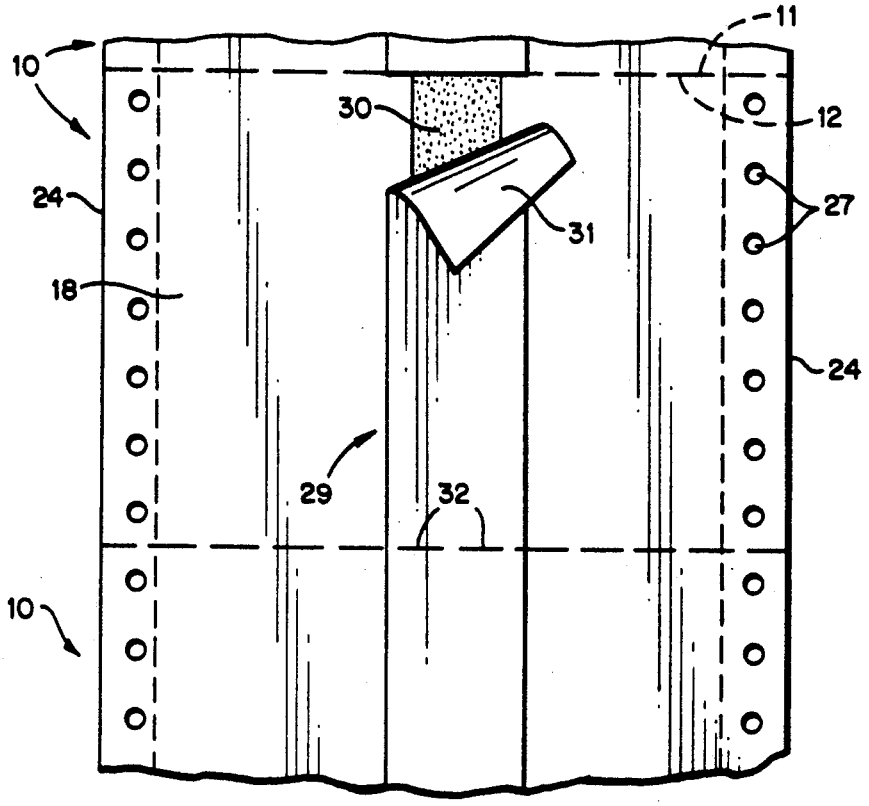
FIG. 4 is a bottom plan view of the form of FIG. 1, and showing it in continuous format.

An exemplary business form according to the present invention is shown generally by reference numeral 10 in FIGS. 1 and 4. As shown in FIG. 4, it may be part of a continuous business form construction with each of the individual forms 10 connected at their top edges 11 and bottom edges 12 to other like forms 10.

Each of the forms 10 comprises a top sheet 13, and a bottom sheet 14. Of course, under some circumstances, other sheets could be provided, and the utilization of the terms "top and bottom sheets" should not be interpreted as limiting the form 10 to only two sheets. The top sheet 13 has a top surface 15 and a bottom surface 16, while the bottom sheet 14 has a top surface 17 and a bottom surface (see FIG. 4) 18. In the preferred embodiment of the invention, both the sheets 13, 14 are made of conventional base paper rather than special label stock or carbonless stock.

On the top surface 15 of the top sheet 13 blockout printing 20 (see FIG. 1) is provided as a security feature. The blockout printing 20 may be provided by any conventional techniques which provide so many confusing characters that information printed on top of the blockout printing 20 is not readable. The blockout printing 20 is preferably provided in strip form—as illustrated in FIG. 1—and overlaps a portion of the top surface 17 of the bottom sheet 14 on which a removable label 21 is disposed.

The top and bottom sheets 13, 14 are releasably connected together, such as by spot pasting (see spot paste 22 in FIGS. 1 and 2) adjacent the top and bottom edges 11, 12. Also connection together is preferably provided by solid pasting, as by strips of adhesive 23 (see FIG. 2) adjacent the side edges 24 of sheets 13, 14. Preferably the strip pasting 23 is provided in removable marginal portions 25 of the sheets 13, 14 separated by perforations 26 from the main middle portion of the sheets 13, 14. The removable marginal portions 25 may have tractor drive openings 27 therein to facilitate feeding of the forms through a printer or like equipment.

In order to allow connection of the bottom sheet 14 to a substrate when the form 10 is being used, it is desirable to provide transfer tape—shown generally by reference numeral 29 in FIG. 4—to the bottom surface 18 of the bottom sheet 14. The transfer tape 29 application to the surface 18 results in a strip of adhesive 30 being provided directly on the surface 18 (the strip 30 typically being parallel to the side edges 24, as illustrated in FIG. 4) with the release material strip 31 applied over the adhesive 30 (i.e., the release strip 31 being the tape substrate of the transfer tape 29). With the forms 10 in continuous form construction as illustrated in FIG. 4, perforations formed along the top and bottom edges 11, 12 of each of the individual forms 10 also go through the transfer tape 29, as illustrated at 32 in FIG. 4.

In order to make the label 21 more readily removable, preferably a means are provided defining a slit 34 in the label stock 35. The label stock 35 has a top surface 36 which engages the bottom surface 16 of the top sheet 13 while the form is being initially handled, with adhesive 37 on the bottom surface thereof as is conventional for a label (see FIG. 3). The label 21 is applied onto the face 17 by adhesively attaching the release sheet 38.

The business form 10 also comprises carbonless imaging means for imaging at least on the label 21 top surface 36 characters formed on the blockout printing 20 by impact printing, writing or the like. A carbonless imaging means preferably comprises self-imaging material, such as shown in U.S. Pat. Nos. 5,024,374 and 4,705,298, or a self-contained coating formulated by Craig Adhesive Company capable of being applied by a Flex-O-Fountain. A self-imaging material may be provided where desired on the top surface 17 of the bottom sheet 14, including on the top surface 36 of the label 35. Alternatively, the carbonless imaging means may comprise a CB coating on the top sheet 13 bottom surface 16, and a CF coating on the bottom sheet 14 top surface 17, including the label stock top surface 36.

Figure 5:
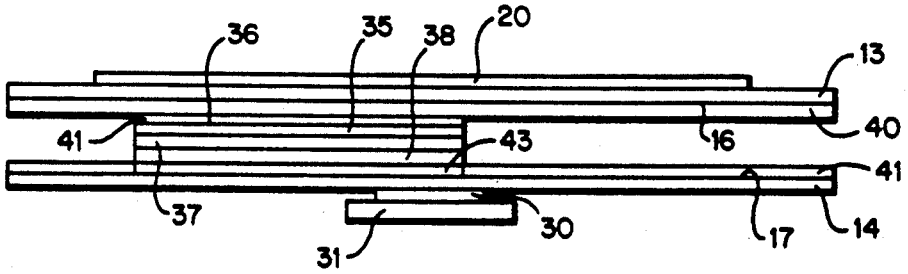
FIG. 5 is a schematic side view of the form of FIG. 1.
Figure 6:
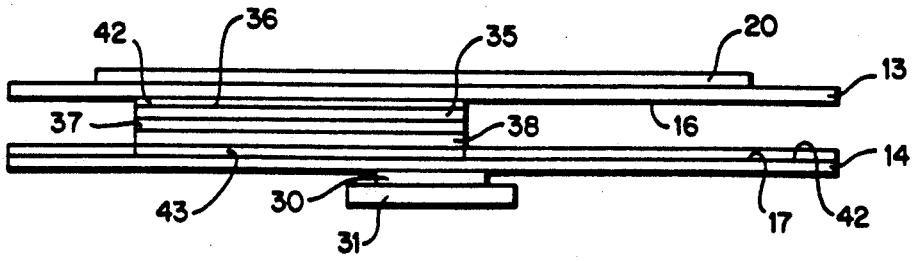
FIG. 6 is a schematic side view of a modification of the form of FIG. 5.

FIG. 5 is a schematic side view of a label 10 according to the invention which includes as the carbonless imaging means a CB coating on the bottom surface 16 of the top sheet 13, and a CF coating on the top surface 17 of the bottom sheet 14, while FIG. 6 is a similar view only where the carbonless imaging means is a self-imaging coating on the bottom sheet 14 top surface 17 and label. In both FIGS. 5 and 6, various individual layers making up the business form 10 have been greatly exaggerated in thickness for clarity of illustration. In an actual final form produced, the thickness of all of the components, except for the sheets 13, 14, the release strip 31, and the label stock 35, would be so thin as not to be discernible by the user.

Note in FIG. 5 that the CB coating is applied to the entire bottom surface 16 of the top sheet 13, although it may be supplied only to selective portions thereof (such as those under the blockout printing strip 20), while the CF coating 41 is applied to the entire top surface 17 of the bottom sheet 14 and the top surface 36 of the label stock 35. The CF coating 41 could be applied to only selective portions of the surfaces 17 and 36, although preferably it is applied to the entire surface 36 and at least a portion of the surface 17 underneath the blockout printing strip 20.

In FIG. 6 the same structures as in FIG. 5 are illustrated by the same reference numerals. The only difference between FIGS. 5 and 6 is that there is no CB coating (40) on the bottom surface 16 of the top sheet 13, and the coating 42 provided on the top surface 17 of the bottom sheet 14 and on the top surface 36 of the label stock 35 is a self-imaging coating. Note that in both FIGS. 5 and 6, the release liner 38 for the label 21 is connected by adhesive 43 to the bottom sheet 14.

Utilizing the business forms 10 according to the present invention, typically different permanent indicia is printed on the sheets 13, 14, such as the indicia 45 in FIG. 1 and the indicia 46 in FIG. 2. Variable data is then printed on both sheets 13, 14 by feeding them through an impact printer (as by utilizing the tractor drive holes 27). For example, the variable data may include variable information 47 that is transferred from the top sheet 13 to the bottom sheet 14 by the carbonless imaging means and is visible on both sheets 13, 14, as well as security information/data 48, 49 (see FIG. 2) that is printed on the blockout printing 20 of the top sheet 13. While data 48, 49 is not visible on surface 15 because of the blockout printing 20, it is visible on the top surface 17 of the bottom sheet 14 since it has been transferred thereto by the carbonless imaging means and there is no blockout printing 20 thereon.

Note that basically the same data—e.g., a password, PIN number, bank account number, etc. —may be printed on the top surface 36 of the label 21, and on the top surface 17 of the bottom sheet 14 immediately adjacent the label 21 (underlying the block printing 20), as the reference numerals 48, 49 illustrate in FIG. 2. Nonvariable data 50 may be printed on both the sheets 13, 14, either being preprinted on the sheets before passing through the variable printer, or being applied by the variable printer itself. What data one desires to transfer from the top sheet 13 to the bottom sheet 14 by the variable printer will determine exactly what parts of the surfaces 16, 17 (or only the surface 17 if self-imaging material is used) will be coated with carbonless imaging means.

In utilization of the form 10, the recipient of the form detaches the top sheet 13 from the bottom sheet 14 along the perforations 26 (the entire marginal portions 25 may be removed), the sheets 13, 14 easily being disconnectable from each other due to the spot pasting 22, and the strip pasting 23 being in the removable marginal portions 25. Once the top sheet 13 has been removed, it may be discarded by the user. However, both the label 21 (the label stock portion 35) and the bottom sheet 14 itself may be of further use. For example, the label stock portion 35 is disconnected along the slit 34 from the transfer sheet 38, and may be applied to any place where the secret data 48 is required (e.g., on a card for one to carry in one's wallet or purse, underneath a video monitor, in one's checkbook, etc.). The sheet 14 may then be retained in a file kept in a confidential location. If it is desired to actually attach the sheet 14 to a substrate in the file, the release strip 31 may be removed so that the adhesive 30 (which may be release adhesive or permanent adhesive) attaches the sheet 14 in place.

In the manufacture of the form 10 according to the invention, especially where the self-imaging coating 42 is utilized, which would obviate the need for relatively costly carbonless special papers, all parts can be run on Webtron equipment requiring only one pass to achieve the desired results. There would be no need to attempt to match sheet length or print/color variations from two different manufacturing processes. Also, the turnaround time on deliveries would be minimal due to the availability of stock paper products. The precise amount of coatings to be applied would be effected by precise use of specially-sized analox cylinders, so that the amount of coating (film thickness) provided could be varied from base paper stock to base paper stock.

While the invention has been herein shown and described in what is presently conceived to be the most practical and preferred embodiments thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A business form comprising:

top and bottom sheets of printable material, each having a top surface and a bottom surface, and releasably retained together with said top sheet substantially coextensive with and covering said bottom sheet, with said top sheet bottom face abutting said bottom sheet top face;

a label affixed to the top surface of said bottom sheet, said label having dimensions significantly less than the dimensions of said top and bottom sheets;

blockout printing provided on said top sheet top surface, said blockout printing substantially overlapping said label; and carbonless imaging means for imaging on label characters formed on said blockout printing.

2. A business form as recited in claim 1 further comprising a strip of adhesive formed on said bottom sheet bottom surface, and a release liner covering said adhesive strip.

3. A business form as recited in claim 2 further comprising means defining a slit in said label allowing ready removal of said label from said bottom sheet.

4. A business form as recited in claim 1 wherein said top and bottom sheets each have top and bottom edges, and first and second side edges, and are connected together by spot pasting along said top and bottom edges.

5. A business form as recited in claim 4 wherein said top and bottom sheets have marginal side portions separated by perforations from a large middle portion, and wherein said top and bottom sheets are further connected together by solid pasting along said first and second side edges in said marginal side portions.

6. A business form as recited in claim 5 wherein said carbonless imaging means comprises a CB coating on said top sheet bottom surface at least in alignment with said blockout printing, and a CF coating on at least said label.

7. A business form as recited in claim 1 wherein said carbonless imaging means comprises a CB coating on substantially the entire bottom surface of said top sheet, and a CF coating on said label and on substantially the entire top surface of said bottom sheet.

8. A business form as recited in claim 1 wherein said blockout printing is provided as a strip on said top sheet covering only a small portion of said top sheet, and further comprising indicia printed on said top sheet outside said blockout printing.

9. A business form as recited in claim 3 wherein said top and bottom sheets each have top and bottom edges, and first and second side edges, and are connected together by spot pasting along said top and bottom edges.

10. A business form as recited in claim 1 wherein said carbonless imaging means comprises a self-imaging coating applied to at least said label.

11. A business form as recited in claim 1 in continuous form, and wherein said carbonless imaging means comprises a self-imaging coating applied to at least substantial portions of said bottom sheet top surface, and including said label.

12. A business form comprising:

top and bottom sheets of base paper, each having a top surface and a bottom surface, and releasably retained together with said top sheet substantially coextensive with and covering said bottom sheet, with said top sheet bottom face abutting said bottom sheet top face;

a label affixed to the top surface of said bottom sheet, said label having dimensions significantly less than the dimensions of said top and bottom sheets;

blockout printing provided on said top sheet top surface, said blockout printing substantially overlapping said label; and carbonless imaging means for imaging on label characters formed on said blockout printing, said carbonless imaging means comprising self-imaging material disposed on at least said label.

13. A continuous form business form comprising a plurality of edge connected continuously connected individual business forms, each individual business form comprising:

top and bottom sheets of printable material, each having a top surface and a bottom surface, and releasably retained together with said top sheet substantially coextensive with and covering said bottom sheet, with said top sheet bottom face abutting said bottom sheet top face;

a label affixed to the top surface of said bottom sheet, said label having dimensions significantly less than the dimensions of said top and bottom sheets;

carbonless imaging means for imaging on label characters formed on said top sheet top surface; and a strip of adhesive formed on said bottom sheet bottom surface, and a release liner covering said adhesive strip.

14. A business form as recited in claim 12 further comprising means defining a slit in said label allowing ready removal of said label from said bottom sheet.

15. A business form as recited in claim 12 wherein said top and bottom sheets each have top and bottom edges, and first and second side edges, and are connected together by spot pasting along said top and bottom edges.

16. A business form as recited in claim 15 wherein said top and bottom sheets have marginal side portions separated by perforations from a large middle portion, and wherein said top and bottom sheets are further connected together by solid pasting along said first and second side edges in said marginal side portions.

17. A business form as recited in claim 13 wherein said carbonless imaging means comprises a self-imaging material covering said label and at least substantial portions of said top surface of said bottom sheet.

18. A continuous form business form as recited in claim 13 wherein said carbonless imaging means comprises a CB coating on substantially the entire bottom surface of said top sheet, and a CF coating on said label and on substantially the entire top surface of said bottom sheet.

19. A business form as recited in claim 12 wherein said blockout printing is provided as a strip on said top sheet covering only a small portion of said top sheet, and further comprising indicia printed on said top sheet outside said blockout printing.

20. A continuous business form as recited in claim 13 wherein said top and bottom sheets each have top and bottom edges, and first and second side edges, and are connected together by spot pasting along said top and bottom edges, and wherein said top and bottom sheets have marginal side portions separated by perforations from a large middle portion, and wherein said top and bottom sheets are further connected together by solid pasting along said first and second side edges in said marginal side portions.

* * * * *